US008931223B2

(12) United States Patent
Speer

(10) Patent No.: US 8,931,223 B2
(45) Date of Patent: Jan. 13, 2015

(54) MASONRY REINFORCEMENT SYSTEM

(71) Applicant: Tie-Cast Systems, Inc., San Diego, CA (US)

(72) Inventor: Barry G. Speer, Escondido, CA (US)

(73) Assignee: Tie-Cast Systems, Inc., San Diego, CA (US)

( * ) Notice: Subject to any disclaimer, the term of this patent is extended or adjusted under 35 U.S.C. 154(b) by 0 days.

(21) Appl. No.: 14/159,792

(22) Filed: Jan. 21, 2014

(65) Prior Publication Data

US 2014/0130434 A1 May 15, 2014

Related U.S. Application Data

(63) Continuation of application No. 13/569,126, filed on Aug. 7, 2012, now Pat. No. 8,667,750.

(60) Provisional application No. 61/521,508, filed on Aug. 9, 2011.

(51) Int. Cl.
*E04B 2/16* (2006.01)
*E04B 2/18* (2006.01)
(Continued)

(52) U.S. Cl.
CPC ... *E04B 2/16* (2013.01); *E04C 1/00* (2013.01); *E04C 5/162* (2013.01); *E04B 2002/0221* (2013.01); *E04B 2002/0254* (2013.01)
USPC ..... 52/223.7; 52/600; 52/604; 52/606; 52/583.1; 52/285.1; 52/293.2; 52/293.3; 52/582.1

(58) Field of Classification Search
CPC ..... E04B 2002/02; E04B 2002/0221; E04B 2002/0247; E04B 2002/0245; E04B 2002/0254; E04B 1/06; E04B 1/22; E04B 1/043; E04B 2/16; E04B 2/42; E04C 5/08; E04C 5/142; E04C 3/20; E04C 3/26; E04H 7/20
USPC ..... 52/223.7, 285.1, 582.1, 583.1, 585.1, 52/293.2, 293.3, 600, 604, 606
See application file for complete search history.

(56) References Cited

U.S. PATENT DOCUMENTS 2,141,397 A * 12/1938 Locke ..... 52/204.2
2,627,176 A * 2/1953 Levy ..... 52/223.7
(Continued)

FOREIGN PATENT DOCUMENTS

JP 2002-043411 2/2002
JP 2002-054045 2/2002
(Continued)

OTHER PUBLICATIONS

International Search Report/Written Opinion dated Jan. 29, 2013 for International Patent Application No. PCT/US2012/049875, filed Aug. 7, 2012.

*Primary Examiner* — Robert Canfield
(74) *Attorney, Agent, or Firm* — Knobbe Martens Olson & Bear LLP

(57) ABSTRACT

A system and method for forming a wall is disclosed. In some embodiments, the wall comprises blocks having internal couplers configured for use with rods which can be inserted through and which are configured to securely lock blocks together. In some embodiments, the rods which are inserted into internal couplers may be threaded or have another locking features such that the blocks in a wall can be securely fastened together.

13 Claims, 8 Drawing Sheets

(51) Int. Cl.

| | |
|---|---|
| ***E04C 1/00*** | (2006.01) |
| ***E04C 5/16*** | (2006.01) |
| *E04B 2/02* | (2006.01) |

(56) References Cited

U.S. PATENT DOCUMENTS

| | | | | |
|---|---|---|---|---|
| 2,826,906 | A | 3/1958 | Rice | |
| 2,929,236 | A | 3/1960 | Steward et al. | |
| 2,963,828 | A * | 12/1960 | Belliveau | 52/564 |
| 2,971,295 | A | 2/1961 | Reynolds | |
| 3,036,407 | A | 5/1962 | Dixon | |
| 3,170,267 | A * | 2/1965 | Rosenfeld | 52/105 |
| 3,295,286 | A | 1/1967 | Schaich | |
| 3,296,758 | A | 1/1967 | Knudsen | |
| 4,726,567 | A | 2/1988 | Greenberg | |
| 5,355,647 | A | 10/1994 | Johnson et al. | |
| 5,561,956 | A | 10/1996 | Englekirk et al. | |
| 5,924,254 | A | 7/1999 | Franklin et al. | |
| 6,098,357 | A | 8/2000 | Franklin et al. | |
| 6,282,859 | B1 | 9/2001 | Van Der Heijden | |
| 6,513,296 | B1 | 2/2003 | Baden | |
| 6,557,316 | B2 | 5/2003 | Van Der Heijden | |
| 6,585,028 | B2 * | 7/2003 | Verdicchio | 160/351 |
| 6,758,020 | B2 | 7/2004 | Cerrato | |
| 6,915,614 | B2 | 7/2005 | Matsufuji | |
| 7,448,179 | B2 | 11/2008 | Schieffer | |
| 8,061,095 | B2 | 11/2011 | Bucheger | |
| 8,099,918 | B2 | 1/2012 | Marsh et al. | |
| 8,201,370 | B1 | 6/2012 | Goodwin | |
| 8,201,379 | B2 | 6/2012 | Bucheger | |
| 8,266,862 | B2 | 9/2012 | Huang | |
| 8,601,759 | B2 * | 12/2013 | Bucheger | 52/223.7 |
| 8,667,760 | B2 * | 3/2014 | Drew | 52/600 |
| 2005/0252118 | A1 | 11/2005 | Matsufuji | |
| 2006/0272245 | A1 | 12/2006 | Matsufuji | |
| 2007/0017176 | A1 | 1/2007 | Gray | |
| 2007/0056235 | A1 | 3/2007 | Kohler | |
| 2007/0079566 | A1 * | 4/2007 | Neill et al. | 52/284 |
| 2007/0107333 | A1 | 5/2007 | Marsh et al. | |
| 2007/0186502 | A1 | 8/2007 | Marsh et al. | |
| 2007/0245673 | A1 * | 10/2007 | Cerrato | 52/607 |
| 2007/0251182 | A1 * | 11/2007 | Van Steinburg | 52/586.1 |
| 2007/0271868 | A1 | 11/2007 | Abella | |
| 2008/0098687 | A1 * | 5/2008 | Marsh et al. | 52/606 |
| 2008/0202054 | A1 * | 8/2008 | Abella | 52/568 |
| 2011/0283647 | A1 | 11/2011 | Fang | |
| 2012/0324820 | A1 | 12/2012 | Drew | |
| 2014/0090325 | A1 * | 4/2014 | Maeers | 52/503 |

FOREIGN PATENT DOCUMENTS

| | | |
|---|---|---|
| JP | 2002-201757 | 7/2002 |
| JP | 2010-065453 | 3/2010 |
| KR | 10-2009-0032471 | 4/2009 |
| WO | WO 2013/022902 | 2/2013 |

* cited by examiner

MASONRY REINFORCEMENT SYSTEM

CROSS-REFERENCE TO RELATED APPLICATIONS

The present application is a continuation of U.S. application Ser. No. 13/569,126, entitled "MASONRY REINFORCEMENT SYSTEM" filed Aug. 7, 2012, which claims the benefit of priority to U.S. Application No. 61/521,508, filed Aug. 9, 2011, both of which are hereby incorporated by reference in their entireties.

BACKGROUND

1. Related Field

The present invention relates to the fields of structural walls and soil-retaining walls.

2. Description of the Related Art

Masonry wall construction is a well-established art. Traditional masonry construction requires the effort of skilled masons to lay hollow concrete block units with mortar to later be grouted in place with continuous reinforcing cast into the system. The process is laborious, expensive, and time consuming. The traditional grouted masonry system is typically used for supporting high lateral load demands such as earth retaining walls and seismic resisting walls. An alternative approach involves bolting systems for stackable masonry systems. Such stackable systems are often preferable to traditional grouted masonry for ease, speed, and economy of installation. Previously-described stackable masonry systems rely on pre-tensioning or post-tensioning attachment of bolts clamped at top and bottom of wall assemblies or to the blocks themselves. These systems transfer tension forces to bearing connections that compress the masonry units. Since the blocks are held in place by compressing the block above and below each individual block unit or above and below the entire wall, the blocks require pre or post-tensioning of the rods, or the wall system would have no lateral restraint capacity. Moreover, the strength of a tension clamped system is difficult to predict or control because of the difficulty in accurately determining the bolt pre or post-tension load. These factors render such walls incapable of resisting lateral loads from forces such as wind, seismic or soil. Because of this, these systems are typically only used in applications where lateral load demand is low.

Related literature includes U.S. Pat. No. 6,915,614, entitled "Bricklaying Structure, Bricklaying Method, and Brick Manufacturing Method"; U.S. Pat. No. 6,282,859, entitled "Building System Comprising Individual Building Elements"; U.S. Pat. No. 5,537,794, entitled "Shear Bolt Connected Structural Units"; U.S. Pat. No. 6,088,987, entitled "Modular Building Materials"; U.S. App. No. 2007/0186502, entitled "Unitized Post Tension Block System For Masonry Structures"; U.S. App. No. 2006/0272245, entitled "Wall Construction of Architectural Structure"; U.S. Pat. No. 6,178,714, entitled "Modular Temporary Building"; U.S. Pat. No. 5,787,675, entitled "Method of Assembling Log Walls For Log House And Clamping Bolt To Couple The Wall".

The present disclosure describes a wall system that is as easy and quick to install as a stackable system, but which avoids the downfalls of those systems and provides the lateral strength and stability of a traditional block and mortar system. Certain embodiments of the present invention provide preferable alternatives to both traditional masonry construction, and to previous stackable systems. Such embodiments provide for walls (e.g. soil-retaining walls) that enjoy the benefits of both previously-known systems, but that do not suffer from the disadvantages of either. Walls as described herein can be quickly and easily assembled and also have a high resistance to lateral forces.

SUMMARY

Some embodiments described herein include a wall system comprising a first block having a first top face and a first bottom face, the first block comprising a first coupler and a second coupler, each of the first coupler and the second coupler disposed within the first block; an interconnect element, wherein the interconnect element is attached to each of the first coupler and the second coupler, and wherein the interconnect element is substantially enclosed within the first block; a first channel formed at least partially within the first block, and at least partially within the first coupler, wherein the first channel terminates on one end at an opening in the first top face, and wherein the first channel terminates on the other end at an opening in the first bottom face; a second block having a second top face and a second bottom face, the second block comprising a third coupler disposed within the second block; a second channel formed at least partially within the second block and at least partially within the third coupler, wherein the second channel terminates on one end at an opening in the second top face, and wherein the second channel terminates on the other end at an opening in the second bottom face; a first rod extending into both the first channel and the second channel, and coupling to the first coupler and the third coupler.

In some embodiments, the wall system further comprises a footing having a fourth coupler coupled to the second block and wherein the first rod is further configured to pass into a third channel in the footing, and wherein the first rod is further configured to couple to the fourth coupler.

In some embodiments, the first rod is a threaded bolt, and the first coupler and the third coupler are internally threaded, and wherein the first rod is further configured to couple to each of the first coupler and the third coupler, by engagement of its threads with the internal threads of each of the first coupler and the third coupler.

In some embodiments, the first rod is formed having protrusions or deformations, and wherein the first coupler and the third coupler comprise a receiver, the receiver having internal dimensions configured to receive the first rod in limited rotational positions and securely retain first rod within the receiver.

In some embodiments, the first rod is formed having grooves and wherein the first coupler and the third coupler comprise a receiver, the receiver having internal dimensions configured to receive the first rod in limited rotational positions and securely retain first rod within the receiver.

In some embodiments, at least a portion of the first bottom face is non-planar, and wherein at least a portion of the second top face is non planar, and wherein the first bottom face forms substantially the minor image of the second top face.

In some embodiments, any one of the first coupler, second coupler or third coupler comprises protrusions configured to anchor the first coupler, second coupler, or third coupler within the block in which the first coupler, second coupler, or third coupler is disposed.

In some embodiments, the first coupler is cast within the first block.

In some embodiments, the second coupler is coupled to a third block by a second rod.

In some embodiments, the first block comprises a masonry material.

In some embodiments, the first block comprises a material other than masonry material.

In some embodiments, at least a portion of the first bottom face is conical.

In some embodiments, each of the first rod and the second rod has a protrusion in the form of a nut.

In some embodiments, each of the first rod and the second rod has a hexagonal concavity configured to receive a male driving socket.

In some embodiments, the second block comprises approximately half of the volume of the first block.

Some embodiments described herein include a wall constructed from the wall system comprising a plurality of staggered rows of blocks; a plurality of columns of couplers located within the blocks; a plurality of rods, wherein each rod is coupled to one coupler in each of the plurality of staggered rows of blocks, and wherein each rod is coupled to a coupler within a footing.

Some embodiments described herein include a system for constructing a wall comprising a plurality of blocks adapted to stack together; one or more couplers located inside each of the blocks; and a plurality of rods, each adapted to be inserted into or through couplers in at least two blocks stacked upon each other.

In some embodiments, the one or more couplers are threaded couplers and the one or more rods are threaded rods.

In some embodiments, the one or more rods are dual-headed rods, and the one or more couplers have an internal structure configured to receive and retain a portion of the one or more dual-headed rods.

In some embodiments, the couplers are affixed inside each of the blocks.

In some embodiments, the couplers are formed inside each of the blocks.

In some embodiments, the couplers are cut inside each of the blocks.

Some embodiments described herein include a construction block, comprising a top, a bottom, a front side, a back side, a first end, and a second end; two parallel channels extending inside the block from the top to the bottom; and a connector located in each of the channels.

In some embodiments, the connector is cast in each of the channels.

In some embodiments, the connector is cut in each of the channels.

In some embodiments, the connector is a threaded connector.

In some embodiments, the top and the bottom comprise mating structures adapted to hold the block in alignment with a matching second block when stacked on such a second block.

Some embodiments described herein include a method of forming a wall comprising providing a wall system as described herein; stacking the first block in a staggered position relative to the second block such that the first channel aligns with the second channel; inserting the first rod into the first channel and the second channel such that the first rod passes into the first coupler and into the third coupler; and rotating the first rod within the first coupler and the third coupler to securely fasten the first block to the second block.

DETAILED DESCRIPTION OF THE CERTAIN EMBODIMENTS

Figure 1:
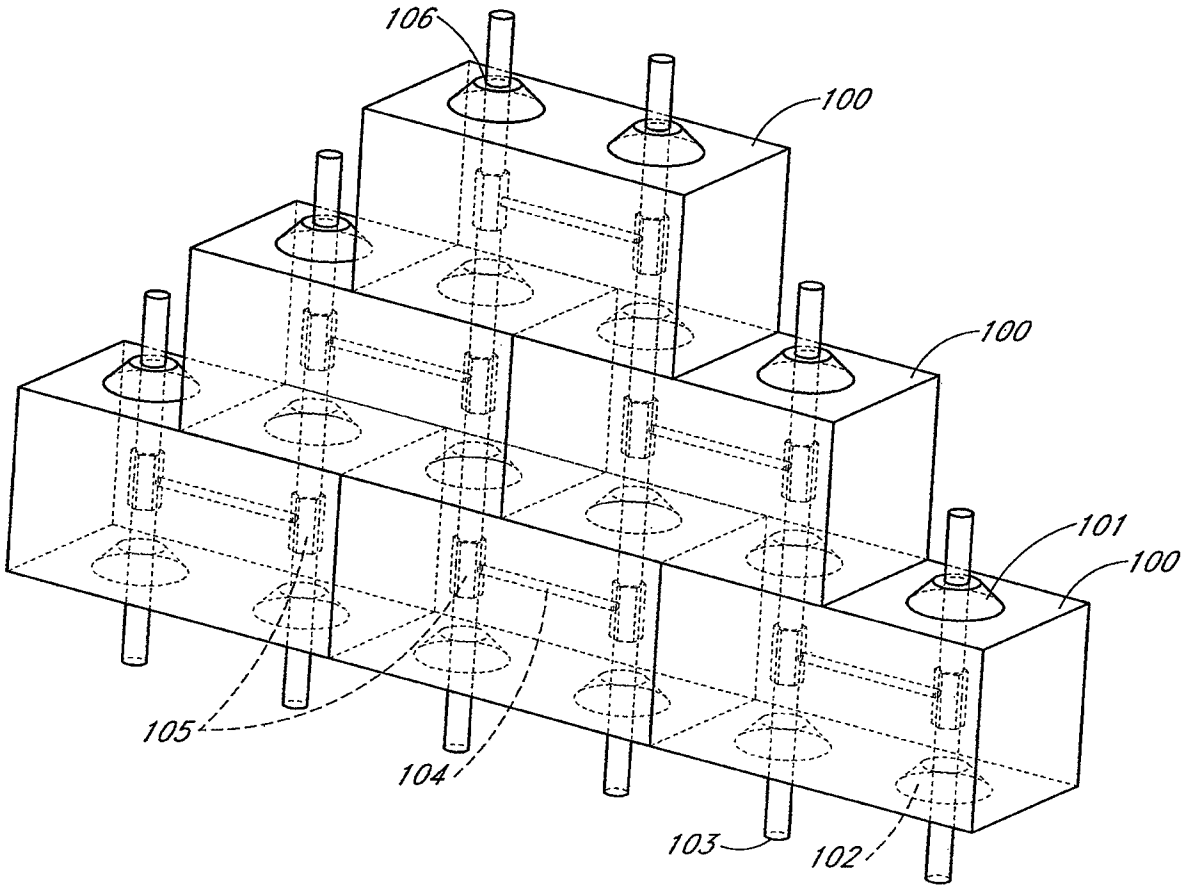
FIG. 1 shows an embodiment of a wall system.

Beginning with reference to FIG. 1, in certain embodiments, a masonry wall structure is composed of a plurality of blocks 100. These blocks 100 may advantageously comprise one or more convex portions 101, and one or more concave portions 102. Preferentially, the concave portions 102 of each block 100 are configured to receive the convex portions 101 from another block 100. For vertical installations, the concave portion 102 and the convex portion 101 can preferentially be located on opposite faces of the blocks. In certain other embodiments, these portions 101, 102 can be located on other faces to allow for non-vertical construction. The blocks 100, of some preferred embodiments, have hollow channels 106 running through the blocks 100, preferably oriented vertically and approximately half way between parallel front and back faces of the block 100. In some embodiments, the hollow channels 106 pass through the same faces of the blocks 100 that comprise the convex portions 101 and concave portions 102 described previously, which can advantageously be top and bottom faces of the block 100.

It will be appreciated by a person of ordinary skill in the art that the convex portion 101, and concave portion 102 of each block 100 can occur on any face. For instance, in some embodiments the convex portion 101 can be on top and the convex portion 102 on the bottom as shown in FIG. 1. In other embodiments, the positions of the portions 101, 102 could be reversed. Alternatively, in some embodiments, blocks 100 could be configured to have both concave 102 and convex 101 portions on each of multiple faces. In many preferred embodiments, one face will minor each of the convex portions 101 and concave portions 102 of another face so that the two faces can stack together when the blocks 100 are stacked. The terms "concave" and "convex" are used broadly, to cover any cooperating structure that will align the blocks when they are stacked or abutted together, holding the blocks in registry or alignment until they are fastened more securely with interconnect members as described below.

In some embodiments the blocks 100 are comprised of traditional masonry materials such as brick, concrete, cement, asphalt, stone, or other similar materials. In other embodiments, alternative natural or man-made materials such as ceramics, plastics, rubbers, composites, woods, acrylics, fiber-reinforced polymers such as fiberglass, or other appropriate substances can be used to form the solid blocks 100. Fibers can be used in some applications to increase the strength or reduce the weight of the blocks. In some embodiments the blocks 100 have a tongue and a groove channel which are configured to interlock with an associated tongue or groove on an adjacent block. The interlocking tongue and groove structures may be disposed along the entire length of the blocks to prevent wind or moisture from penetrating through the wall joints. In some embodiments textures may be cast into the block faces for aesthetic or functional benefit. In some embodiments the blocks 100 are solid. In some embodiments, the blocks 100 can be porous, honeycombed, latticed, foamed, woven, hollow, or of any other suitable form, in configurations that provide sufficient support for the receiving elements 105 described below.

As can be appreciated by a person of ordinary skill in the art, in applications in which weight of the blocks 100 is a concern, the solid masonry units can be cast with lightweight concrete or composites to mitigate increased weight that could result from installing solid as opposed to hollow units 100. For example, any of the known lightweight concrete materials can be used, including lightweight aggregates, foamed concretes and those incorporating fly ash, ceramic spheres, glass spheres, wood fiber, and the like. Furthermore, materials used to form the blocks 100 may be selected to provide desired properties, such as weather resistance, heat resistance, resistance to solvents, acids, bases, oxidants, or other harmful agents present in the environment, aesthetic preference, resistance to mechanical load, vibrations, or other stresses, or other practical considerations as would be apparent to a person of ordinary skill in the art.

In certain embodiments, the blocks 100 are stacked vertically so that the concave portion 102 of one block 100 interfaces flush with the convex portion 101 of another block 100. In some embodiments, the blocks are stacked such that a tongue on one block interfaces with a groove on another block. In some embodiments, the blocks 100 can be staggered so that a first concave portion 101 of a first block 100 interfaces with a first convex portion 102 of a second block 100 and so that a second concave portion 101 of the first block 100 interfaces with a second convex portion 101 of a third block 100. As can be appreciated, the locations of concave 102 and convex 101 portions can be in any other permutation. A person of ordinary skill in the art will appreciate that different staggering patterns and different patterns of concave and convex portions 101, 102 can provide advantages in various applications, including tying a wall together and avoiding vertical propagation of cracks or movement of the finished wall.

In some preferred embodiments, the concave and convex portions 102, 101 are conical, truncated conical, or substantially conical in shape. Optionally, channels 106 pass through the apex of these conical portions 101, 102. In a stacked vertical wall, for example, in one preferred embodiment the hollow channels 106 run vertically, as illustrated, passing entirely through the blocks 100 from top to bottom In some preferred embodiments, interconnect elements 104 are provided that connect to and preferably support receiving elements 105, which preferably are located in the channels 106. Thus, in one preferred vertical wall embodiment illustrated in FIG. 1, each full block 100 has at least two parallel, vertically-extending channels 106 passing through the block 100, while half-blocks (generally half the size of the full block) preferably have at least one vertically-extending channel 106 passing therethrough. The interconnect elements running orthogonal to and interconnecting with the channels 106 may advantageously be cast in place within a block 100, or alternatively may be glued, pinned, or otherwise fastened into the block 100. In some block materials, the channel 106 and receiving element 105 may be formed into or cut from the block material rather than comprising separate components. The interconnect members 104 are preferably composed of rigid materials, preferably with significant tensile strength, such as a metal or metal alloy (e.g. iron, steel, etc.), a plastic, a fiberglass, a composite, or other functionally-compatible material as would be appreciated by a person of ordinary skill in the art. However, in certain embodiments, the interconnect members 104 may be comprised of moderately-rigid or non-rigid materials to allow elasticity and flex within the wall system as required in a particular installation, and as can easily be appreciated by a person of ordinary skill in the art.

Figure 2:
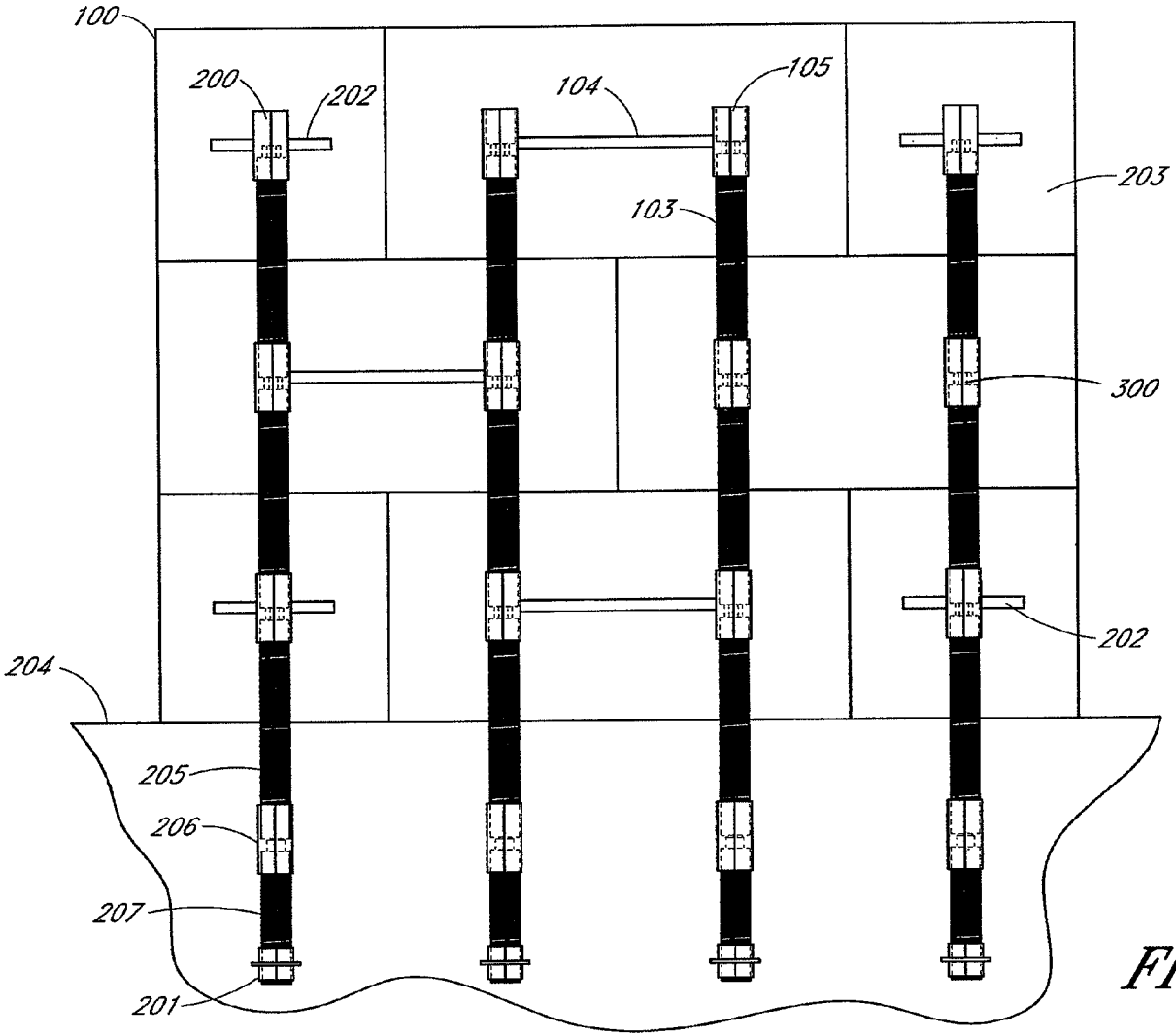
FIG. 2 shows a detailed view of an embodiment of the interior of the wall system of FIG. 1.

Now with reference to FIG. 2, in some embodiments, the interconnect elements 104 are long enough to pass through many blocks 100 in a wall. In other embodiments, with blocks 100 that are substantially twice as long as they are high, the interconnect elements 104 are approximately the same length as the height of one block 100 (or half the length of that block), and can be configured so that each end couples to a coupling device 105, 200, in the body or adjacent to each coupling device of each of two blocks 100. In some embodiments, blocks 100 can comprise either two coupling devices 105 connected by an interconnect element 104, or one coupling device 200. Optionally, a coupling device may comprise stabilization protrusions 202 extending orthogonally from or adjacent to the coupling device 200 into the block 100, configured to stabilize the coupling device 200 within block 100 with respect to lateral or vertical movement or rotation. In one preferred embodiment, a full block 100 will utilize horizontally-extending interconnect elements 104 cast into the block between multiple coupling devices 105, while a half block will utilize horizontally-extending stabilization protrusions 202 extending from the coupling devices 105.

For optimal stability, the wall is preferably connected to a footing 204, extending down into the earth or otherwise in or on a stable bearing material. The footing 204 may be equipped with anchor assembly comprising a support rod 207, 205, an anchor 201, and a coupling 206. Anchor structure 201, may be attached within the footing 204. For instance, the anchor 201 can be cast into a concrete footing 204. The anchor provides a mechanical coupling to one or more support rods 207, 205. In the case that there are multiple support rods, the rods 207, 205 may be connected to one another by a coupling 206. In such cases, the coupling 206 may optionally provide anchor support with respect to the footing 204, for instance with protrusions (not shown). The entire anchor assembly is preferably attached, either through a coupling 206, or directly from the anchor 201, to the rods 103 or coupling devices 200 of the wall system. Thus, with reference to FIG. 2, in one embodiment, the anchor 201 is cast into a concrete footing, and a vertical channel is cast or formed in the footing extending upward from the anchor 201 to the top of the footing, to permit insertion of rods 205, 207 and coupling 206 (if used) to connect from the blocks 100 down to the anchor 201. Alternatively, in another embodiment, the anchor 201, rod 207, and coupling 206 are cast into the footing 204, and the rod 205 is inserted later (e.g., through a channel formed above coupling 206 or through a sleeve extending upward from coupling 206). In yet another embodiment, an epoxy dowel may be used to attach an anchor 201, or a rod 207 to the footing 204. This last method allows installers to pour a clean footing 204 without precast elements, or to retrofit a wall of the current embodiment to a footing 204 that was previously poured for a different purpose.

In some preferred embodiments, the rods 103, 205, 207, are not distinct units but comprise single units that can be driven, turned, or threaded from the top of the constructed wall completely through into the footing 204. In such embodiments, these interlocking rods 103 create a continuous and unbroken vertical tie between all of the couplings 105, 206, 201. Such continuous rods 103 may also be integrally tied to or threaded to the blocks 100 through casting of the coupler assembly 104, 105, into each of the blocks 100 and then turning or threading the rods 103 through those couplers. The running bond configuration of the masonry construction with the interconnect members 104, along with the continuous nature of the rod 103, also provides a horizontal interlock between masonry units.

Figure 3A:
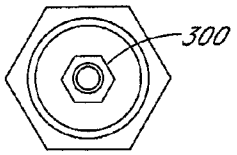
FIG. 3A shows a top view of a bolt from the wall system of FIG. 2.
Figure 3B:
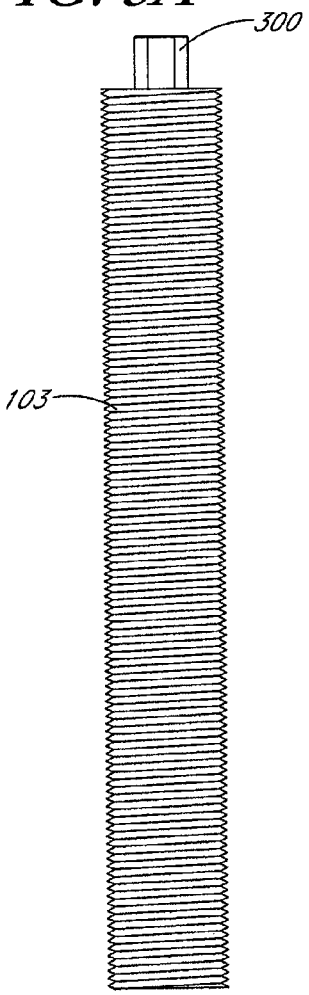
FIG. 3B shows a bolt from the wall system of FIG. 2.

Referring now to FIG. 3, in some preferred embodiments, the rods 103 can comprise threaded rods adapted to screw into the coupling devices 105. In some embodiments, the rods 103 can screw completely through the coupling devices so as to connect multiple coupling devices 105 with one interconnect rod 103. In other embodiments, the coupling devices 105 can be provided with stops or partial threading so that a rod cannot completely pass through the device 105. In such embodiments, each rod 103 would connect to only two coupling devices 105. In some embodiments, only a portion of the rod 103 is threaded with the rest of the rod 103 smooth or otherwise textured. In some embodiments, the rods 103 further comprise heads 300 (e.g. a hexagonal protrusion at one end of the rod in the form of a nut, smaller than the diameter of the threads of the rod 103). In some embodiments, such heads 300 may serve as heads that facilitate the attachment of a socket wrench to drive the bolt into (including though) the coupler 105; in such embodiments it is optional for the heads 300 to serve as connectors, they may be connectors, attachments for a socket, or both. In some embodiments, head 300 may comprise a hexagonal concavity, configured to receive a hexagonal male socket or similar tool. As will be appreciated by a person of ordinary skill in the art, the heads 300, may comprise protrusions, concavities, or any other appropriate topographical pattern with any appropriate cross-sections (e.g. square, rectangular, trapezoidal, star, irregular closed curve, etc.) within the spirit and scope of these embodiments. Such alternate heads 300 will optimally be configured to attach to a driving socket or other tool for rotating the rod 103 and driving it into a coupling device 105 or 200.

Figure 4A:
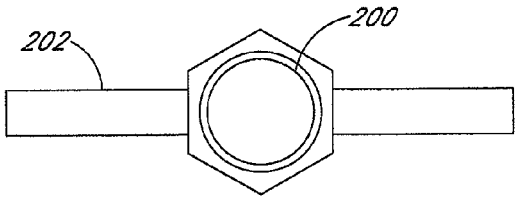
FIG. 4A shows a top view of a coupler of the wall system of FIG. 2.
Figure 4B:
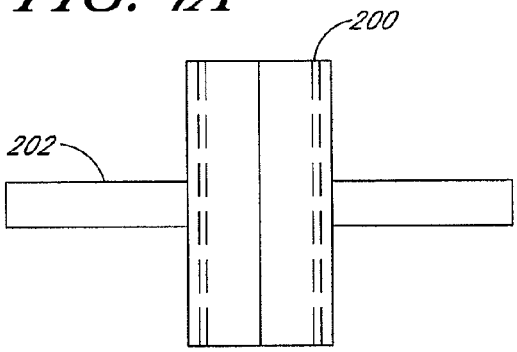
FIG. 4B shows a coupler of the wall system of FIG. 2.

Referring now to FIG. 4, certain embodiments include coupling devices 200, which are not connected to any other coupling device, and which have protrusions 202 for resisting motion within the block. Such coupling devices 200 are particularly well suited to use in blocks 203 with only one coupling device 200, e.g., half blocks. For instance, when a staggered pattern is used for stacking blocks 100, as described above, it may be desirable to have shorter-length half blocks 200, to complete the ends of the staggered pattern (see, for instance, FIG. 2).

Figure 5A:
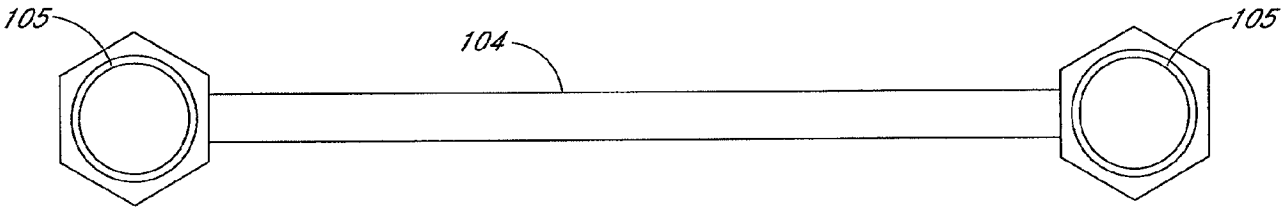
FIG. 5A shows a top view of a coupler and interconnect system from the wall system of FIG. 2.
Figure 5B:
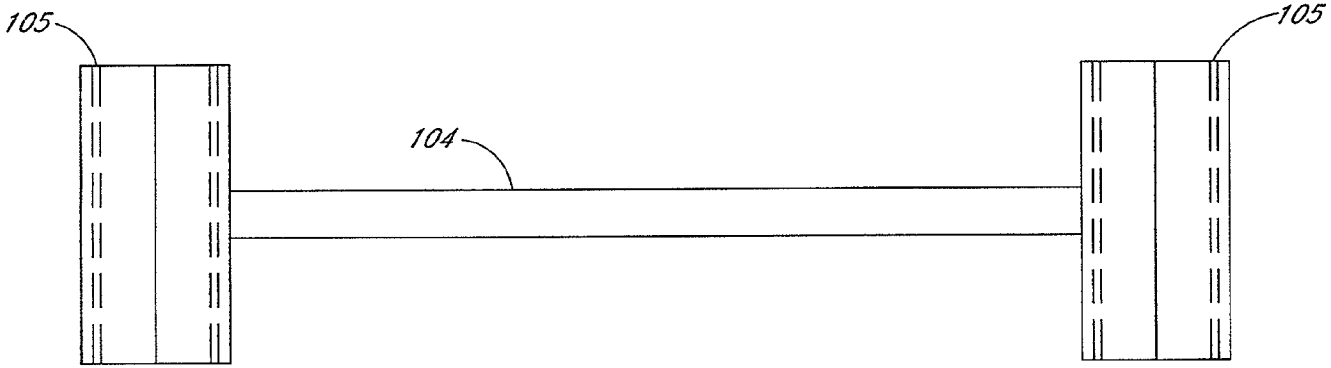
FIG. 5B shows a side view of a coupler and interconnect system from the wall system of FIG. 2.

Referring to FIGS. 5A and 5B, an interconnect element 104 as described above is attached to two coupling devices 105.

Figure 6A:
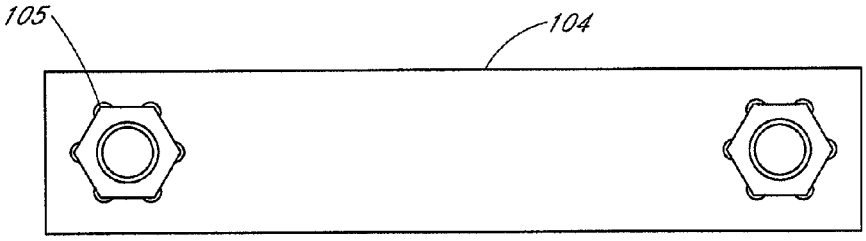
FIG. 6A shows a top view of an embodiment of a coupler and interconnect system from the wall system of FIG. 2.
Figure 6B:
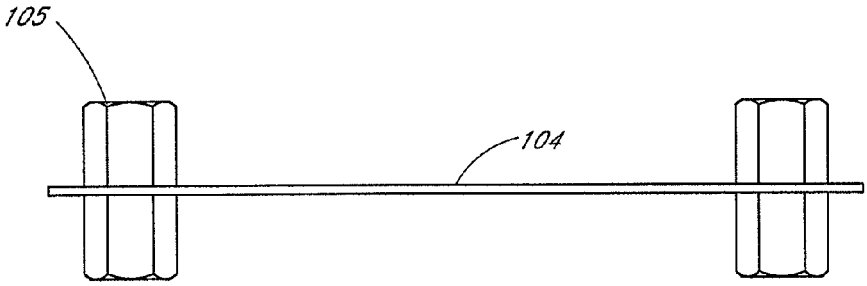
FIG. 6B shows a side view of an embodiment of a coupler and interconnect system from the wall system of FIG. 2.

Referring to FIGS. 6A and 6B, an interconnect element 104 is attached to the body of two coupling elements 105 (at, above or below the approximate vertical center of each coupling device). In some embodiments, the interconnect element 104 is attached to the two coupling devices 105 by means of a mechanical or hydraulic press. Optionally, the attachment may be made by means of a weld, bond or other process.

Figure 7A:
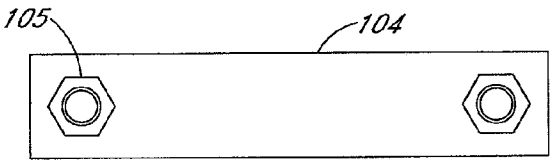
FIG. 7A shows a top view of an embodiment of a coupler and interconnect system from the wall system of FIG. 2.
Figure 7B:
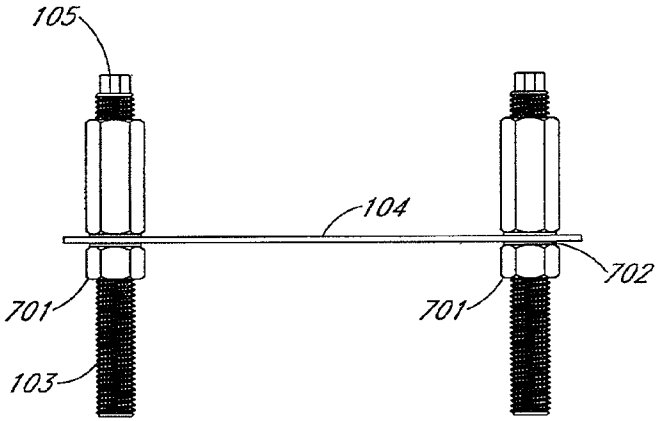
FIG. 7B shows a side view of an embodiment of a coupler and interconnect system from the wall system of FIG. 2 in a final position.
Figure 7C:
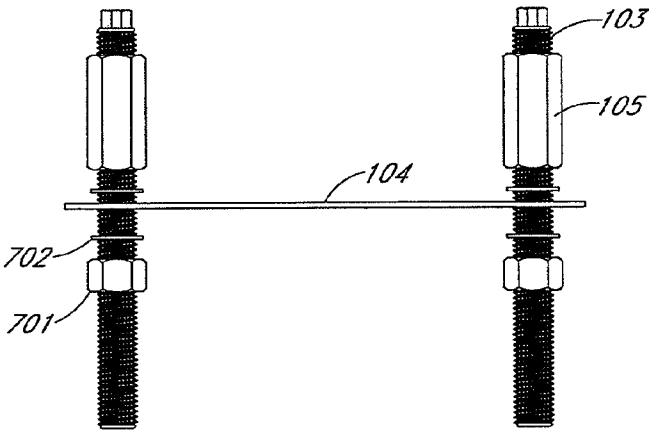
FIG. 7C shows a side view of a coupler and interconnect system from the wall system of FIG. 2 in an intermediate position.

FIGS. 7A-C depict an interconnect assembly comprising an interconnect element 104, coupling devices 105, a companion elements 701, and a sealing element 702. Interconnect element 104 is attached to the coupling devices 105 at a location adjacent to an end of coupling element 105. Sealing element is disposed between the end of coupling device 105 and interconnect element 104. A companion element 701 is further positioned adjacent to interconnect element 104, with a sealing element 702 disposed therebetween. Companion element 701 and coupling device 105 sandwich interconnecting element with sealing elements 702 disposed between, as depicted. The configuration of coupling device 105 and companion element 701 is such that when an interlocking rod 103 is placed in a position passing through the coupling element 105, interconnect element 104, companion element 701, sealing elements 702, the interconnect element 104 is secured in a fixed position orthogonal to the interlocking rod 103, coupling element 105 and companion element 701.

FIG. 7A depicts a top view of an interconnect assembly. FIG. 7B depicts the interconnect assembly with the coupling device 105 and companion element 701 in a locked, tightened, or final position. In the locked, tightened, or final position, coupling device 105 and companion elements 701 sandwich their respective sealing elements 702 against interconnect element 104. FIG. 7C depicts the interconnect assembly with coupling device 105 and companion element 701 in an intermediate position, prior to sandwiching their respective sealing elements 702.

Figure 8A:
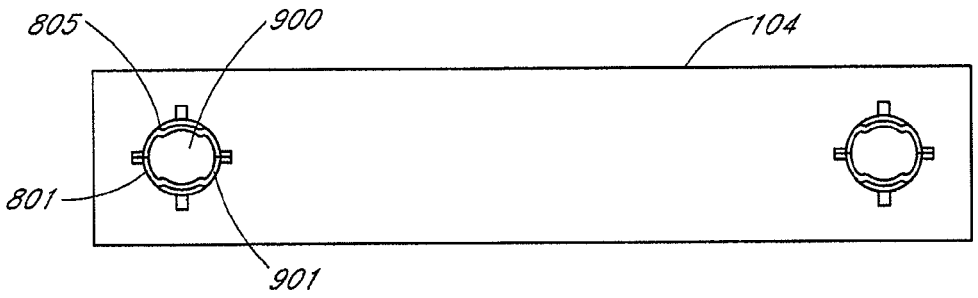
FIG. 8A shows a top view of an embodiment of a coupler and interconnect system from the wall system of FIG. 2.
Figure 8B:
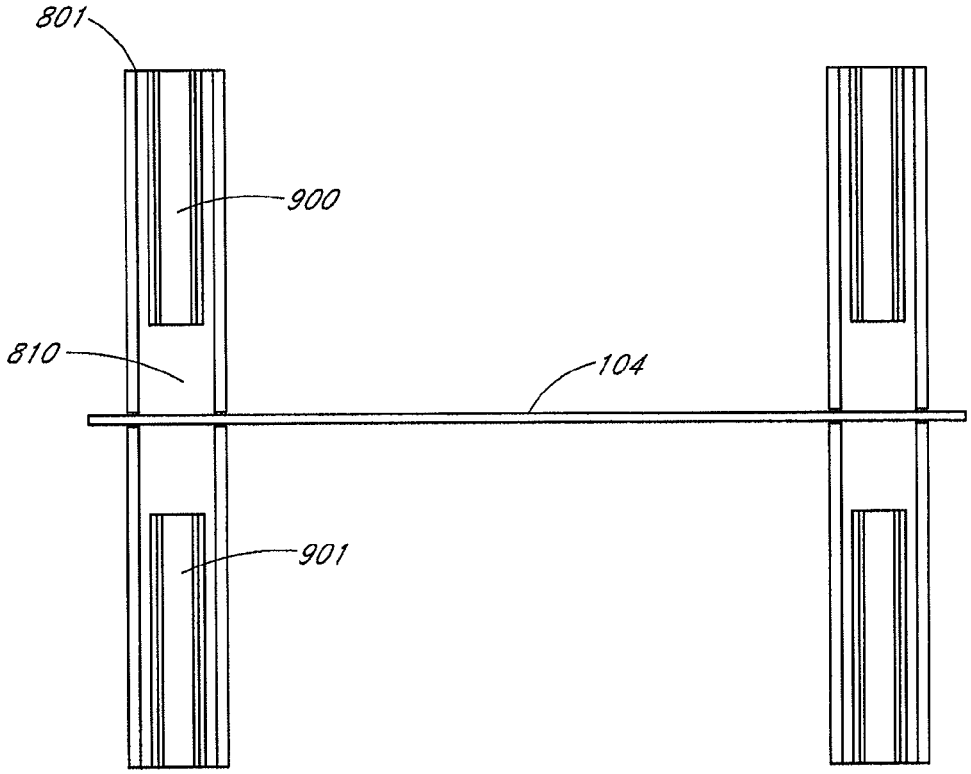
FIG. 8B shows a side view of an embodiment of a coupler and interconnect system from the wall system of FIG. 2.
Figure 9:
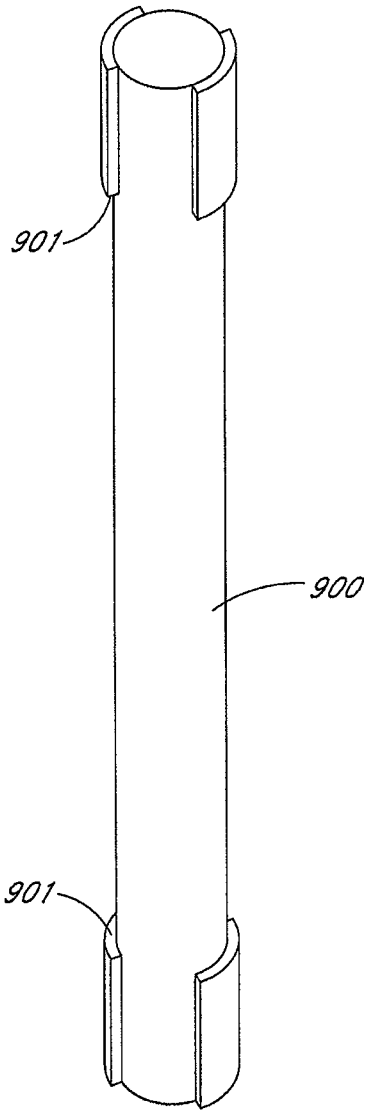
FIG. 9 shows an embodiment of a bolt from the wall system of FIG. 2 for use in conjunction with the coupling system in FIG. 8.

Referring to FIG. 8A and 8B, some embodiments of an interconnect assembly comprise a coupling element 801. Coupling elements 801 comprise a hollow cylinder with walls and chambers that form a receiver or channel configured to receive and securely connect to a dual-headed rod 900 as depicted in FIG. 9. In some embodiments, the coupling element 801 has wall deformations, contours, or indentations 805 that allow one head of a dual-headed rod 900 to pass through a top or first opening of the coupling element 801 and the head of a second dual-headed rod 900 to pass through a bottom or second opening of the coupling element 801 such that one head of the first dual-headed rod is coterminously located with the head of the second dual-headed rod in a central section or chamber 810 of coupling element 801. The internal dimensions of coupling elements 801, including deformations, contours, or indentations 805 disposed therein are configured to interact with protrusions 901 of the dual-headed rods 900 such that the heads of the dual-headed rods 900 will pass into or out of the coupling element 801 only in limited rotational positions. The central chamber 810 of the coupling element 801 is formed as an open cylinder that allows full rotation of the head of the dual-headed rod 900, including protrusions 901. The dimensions of the wall deformations, contours, or indentations 805 further serve to deter passage of the heads of the dual-headed rods 900 away from central chamber 810 of the coupling element 801 when the head of the dual-headed rod 900 is in certain rotational positions. Protrusions 901 interact with wall deformations, contours, or indentations 805, thereby securely connecting and retaining dual-headed rod 900 within coupling element 801. In some embodiments, coupling element 801 is comprised of two separate plates that have been formed independently, then brought together to create one coupling element 801. In some embodiments, the coupling element 801 is cast, milled, or otherwise created from a single unit of material.

Referring to FIG. 9, in some preferred embodiments, dual-headed rod 900 may be used in conjunction with coupling element 801. Dual-headed rod 900 comprises a smooth rod with a length approximately equal to the height of a block 100 with both ends of the rod deformed, contoured, or having a protrusion 901, such that each end or head has a special-designed shape that will allow the head of the dual-headed rod 900 to pass through the opening of coupling element 801 and into the cylindrical chamber in the central section of coupling element 801. The deformations, contours, or protrusions 901 of each end of the dual-headed rods 900 are complimentary to the corresponding deformations, contours, or protrusions 901 formed into the two ends of the coupling element 801. In such embodiments, when one head of the dual-headed rod 900 passes through an opening in the coupling element 801 into the central chamber and is rotated such that the deformations, contours, or protrusions 901 in the head of the dual headed rod 900 no longer are in alignment with the deformations, contours, or indentations in the opening of the coupler element 801, a mechanical coupling is created that deters the retraction of the dual-headed rod 900 from the coupling element 801. Further, when a dual-headed rod 900 is inserted through the coupling element 801 cast into one block 100 such that the upper head of dual-headed rod 900 rests within the cylindrical chamber within that coupling element 801 and the lower head of the dual-headed rod 900 rests within the cylindrical chamber of a coupling element 801 cast into a separate block 100 situated immediately below the first block 100, and the dual-headed rod 900 is rotated such that the deformations, contours, or protrusions 901 of the heads of the dual-headed rod 900 are no longer in alignment with the deformations or contours in the coupler elements 801 in the blocks 100, blocks 100 are coupled together and restrained from being pushed apart.

In assembling a wall from the blocks 100 as described herein, one exemplary embodiment is as follows: A footing 204 is formed, with threaded anchors 201 (and/or 206) cast thereinto. The anchors are accessible from the top of the footing so that threaded rod 103 (or 205, 207) can be inserted thereinto from above the footing 104, and such accessibility can be provided, e.g., by channels formed in the footing 104 at the time it is poured or thereafter, or through sleeves extending upward from the threaded anchors 201 or 206. The horizontal spacing of the anchors is the same as or is a multiple of the spacing of channels 106 in the stacked blocks 100. Thereafter, blocks 100 are stacked on the footing 104, with channels 106 in the block lining up with the anchors 201 in the footing. In one embodiment, after each layer of block 100 is stacked, a threaded rod 103 is driven through a threaded coupling device 105 in that block and into the coupling device 105 or anchor 201 or 206 in the block or footing immediately below, leaving the top of the threaded rod 103 preferably about half way through the coupling device 105 in the topmost block. Then the next layer of block 100 is stacked, using the convex and concave portions 101 and 102 to align the blocks and the channels 106, and the threaded rods 103 are inserted as above to tie that layer to the layer beneath. Alternatively, several layers can be stacked at once, and then a longer rod 103 can be driven through all of the layers. Note that unlike prior proposed building block systems, this building system does not rely on tension in rods 103 to maintain the system in place and to provide structural strength. Note also that although the full blocks 100 in the exemplary embodiments are approximately half as high as they are long, and have two vertical channels 106 running therethrough, other ratios of height to width are contemplated, as are other numbers of channels, e.g., 1, 3, 4, or more channels. Moreover, although the depth of an individual full block can advantageously be the same as the height and half of the width, with a half block being cubical, those ratios can also be varied as desired.

Another embodiment of wall assembly is similar to the process described in the exemplary embodiment above. The second embodiment differs only by the substitution of the dual-headed rod 900 for the threaded rod 103, and the substitution of the coupling element 900 for the threaded coupling device 105. According to this embodiment, installation is simplified by installing the dual-headed rod with a short manual turn rather than the driving of a threaded rod.

One embodiment of fabricating a block 100 includes the use of moveable mold liners with a traditional dry cast block making machine such as the system presented in U.S. Pat. No. 7,156,645 B2. Dry cast block machines utilize a zero-slump concrete mix formed with vibration and pressure to reach high production rates of traditional concrete block. Using a moveable mold liner system in conjunction with the dry-cast block machine enables the incorporation of textures and the imprinting of concave and convex portions as well as any tongue and groove channels desired in the various iterations of this block product Another method of block fabrication includes the casting of wet mix concrete into molds that incorporate textures, the imprinting of concave and convex block mating features, tongue and groove channels for various facets of utility previously detailed, and casting of the internal coupling system, as well as other channels for various functions. As can be appreciated by a person of ordinary skill in the art, many of the embodiments discussed above provide for systems that have the advantages of the traditional grouted concrete masonry system as well as the advantages of a mortarless, stackable system. Various embodiments have the ability to resist vertical and lateral loads in the same fashion as the traditional grouted masonry wall with a continuous tension resisting element cast into the units, while also retaining the advantage of quick, simple and inexpensive installation of pre-manufactured boltable units. Unlike previous systems, the connection of the rods and couplers in the various embodiments require no tension. This is because the couplers are fixed, formed, or cut into the blocks so that they cannot rotate or move within the blocks as the bolts are connected to the couplers. Tension only develops during lateral loading as is the case in traditional masonry construction. The blocks retain the benefit of being cast integrally with the block and also have the advantage of being solid cast units requiring no mortar or grouting for installation. The structural analysis for determining the lateral strength of walls of various embodiments is no different from the traditional grouted wall design since the structural mechanism is the same. The relevant material property of the block is compressive strength. High compressive strength lightweight materials such as wood, plastics, fiberglass, and composites represent viable alternatives to concrete blocks, and provide the required compressive strength to equal traditional concrete masonry compressive strengths while allowing a solid block weight to be similar to that of the hollow concrete masonry block weight of some stackable systems. Where the importance of heat resistant materials supersedes the need for lightweight blocks, conventional or lightweight concrete may be used.

What is claimed is:

1. A wall system comprising:

a first block having a first top face and a first bottom face, the first block comprising a first coupler and a second coupler, each of the first coupler and the second coupler disposed within the first block;

an interconnect element, wherein the interconnect element is attached to each of the first coupler and the second coupler, and wherein the interconnect element is substantially enclosed within the first block;

a first channel formed at least partially within the first block, and at least partially within the first coupler, wherein the first channel terminates on one end at an opening in the first top face, and wherein the first channel terminates on the other end at an opening in the first bottom face;

a second block having a second top face and a second bottom face, the second block comprising a third coupler disposed within the second block;

a second channel formed at least partially within the second block and at least partially within the third coupler, wherein the second channel terminates on one end at an opening in the second top face, and wherein the second channel terminates on the other end at an opening in the second bottom face;

a first rod extending into both the first channel and the second channel, and coupling to the first coupler and the third coupler, wherein the first rod is formed having protrusions or deformations; and wherein the first coupler and the third coupler comprise a receiver, the receiver having internal dimensions configured to receive the first rod in limited rotational positions and securely retain the first rod within the receiver.

2. The wall system of claim 1, further comprising a footing having a fourth coupler coupled to the second block and wherein the first rod is further configured to pass into a third channel in the footing, and wherein the first rod is further configured to couple to the fourth coupler.

3. The wall system of claim 1, wherein any one of the first coupler, second coupler or third coupler comprises protrusions configured to anchor the first coupler, second coupler, or third coupler within the block in which the first coupler, second coupler, or third coupler is disposed.

4. The wall system of claim 1, wherein the first coupler is cast within the first block.

5. The wall system of claim 1, wherein the second coupler is coupled to a third block by a second rod.

6. A wall constructed from the wall system of claim 5 comprising:

a plurality of staggered rows of blocks;

a plurality of columns of couplers located within the blocks;

a plurality of rods, wherein each rod is coupled to one coupler in each of the plurality of staggered rows of blocks, and wherein each rod is coupled to a coupler within a footing.

7. A method of forming a wall comprising:

providing the wall system of claim 1;

stacking the first block in a staggered position relative to the second block such that the first channel aligns with the second channel;

inserting the first rod into the first channel and the second channel such that the first rod passes into the first coupler and into the third coupler; and rotating the first rod within the first coupler and the third coupler to securely fasten the first block to the second block.

8. A wall system comprising:

a first block having a first top face and a first bottom face, the first block comprising a first coupler and a second coupler, each of the first coupler and the second coupler disposed within the first block;

an interconnect element, wherein the interconnect element is attached to each of the first coupler and the second coupler, and wherein the interconnect element is substantially enclosed within the first block;

a first channel formed at least partially within the first block, and at least partially within the first coupler, wherein the first channel terminates on one end at an opening in the first top face, and wherein the first channel terminates on the other end at an opening in the first bottom face;

a second block having a second top face and a second bottom face, the second block comprising a third coupler disposed within the second block;

a second channel formed at least partially within the second block and at least partially within the third coupler, wherein the second channel terminates on one end at an opening in the second top face, and wherein the second channel terminates on the other end at an opening in the second bottom face;

a first rod extending into both the first channel and the second channel, and coupling to the first coupler and the third coupler, wherein the first rod is formed having grooves;

and wherein the first coupler and the third coupler comprise a receiver, the receiver having internal dimensions configured to receive the first rod in limited rotational positions and securely retain first rod within the receiver.

9. The wall system of claim 8, further comprising a footing having a fourth coupler coupled to the second block and wherein the first rod is further configured to pass into a third channel in the footing, and wherein the first rod is further configured to couple to the fourth coupler.

10. The wall system of claim 8, wherein any one of the first coupler, second coupler or third coupler comprises protrusions configured to anchor the first coupler, second coupler, or third coupler within the block in which the first coupler, second coupler, or third coupler is disposed.

11. The wall system of claim 8, wherein the first coupler is cast within the first block.

12. The wall system of claim 8, wherein the second coupler is coupled to a third block by a second rod.

13. A wall constructed from the wall system of claim 11 comprising:

a plurality of staggered rows of blocks;

a plurality of columns of couplers located within the blocks;

a plurality of rods, wherein each rod is coupled to one coupler in each of the plurality of staggered rows of blocks, and wherein each rod is coupled to a coupler within a footing.

* * * * *